United States Patent [19]

Reiners et al.

[11] Patent Number: 4,589,602

[45] Date of Patent: May 20, 1986

[54] AUTOMATIC WINDING MACHINE

[75] Inventors: Franz-Josef Reiners, Ratheim; Herbert Knors, Mönchen-Gladbach; Leo Tholen, Heinsberg; Heinz-Lorenz Topütt, Mönchen-Gladbach, all of Fed. Rep. of Germany

[73] Assignee: W. Schlafhorst & Co., Mönchen-Gladbach, Fed. Rep. of Germany

[21] Appl. No.: 559,867

[22] Filed: Dec. 8, 1983

[30] Foreign Application Priority Data

Dec. 8, 1982 [DE] Fed. Rep. of Germany ..... 3245326

[51] Int. Cl.[4] ..... B65H 54/20; B65H 67/06

[52] U.S. Cl. ..... 242/35.5 R; 242/35.5 A; 242/35.6 R

[58] Field of Search ..... 242/35.5 R, 35.5 A, 242/35.6 R, 35.6 E; 139/249, 250

[56] References Cited

U.S. PATENT DOCUMENTS

| | | | |
|---|---|---|---|
| 3,033,478 | 5/1962 | Furst | 242/35.6 R |
| 3,160,358 | 12/1964 | Furst | 242/35.5 R |
| 3,265,316 | 8/1966 | Furst | 242/35.6 R |

FOREIGN PATENT DOCUMENTS

| | | | |
|---|---|---|---|
| 31870 | 2/1983 | Japan | 242/35.6 E |

*Primary Examiner*—Stanley N. Gilreath

*Attorney, Agent, or Firm*—Herbert L. Lerner; Laurence A. Greenberg

[57] ABSTRACT

An automatic winding machine, includes a plurality of winding stations each having a bobbin unwinding location, a plurality of bobbin magazines each disposed at a respective winding station for receiving a plurality of bobbins on bobbin tubes in order with respect to their tips, the bobbins each having a thread end prepared for unwinding at a given location thereon, and a thread suction device disposed above each respective bobbin magazine having a suction opening formed therein facing the upper end of a bobbin tube of a bobbin disposed in the bobbin magazine to be transferred to the unwinding location.

8 Claims, 11 Drawing Figures

AUTOMATIC WINDING MACHINE

The invention relates to an automatic winding machine with a plurality of winding stations at which magazines are disposed for holding a plurality of bobbins inserted with their tips in order, and the end of the thread prepared so as to be easily accessible at a determined location of the bobbin or bobbin tube, such as by inserting the thread into the interior of the tube.

The magazine for the feeding or creel bobbins which are disposed at each winding station of the automatic winding machine, serve the specific purpose of preventing the operation of the machine in an empty condition. Not every creel bobbin is initially suited for furtner processing. For example, the thread end may be hard to find, it may be intertwined with other thread ends, it may be hooked to other machine parts, the creel bobbin may be too small, or the like. For these reasons, it is frequently the case that individual creel bobbins, or even several bobbins one after the other, are rejected by the winding station, because they are unsuited for further processing. In this case it is a disadvantage if a creel bobbin is supplied to the winding station only after it reports the need for one. A magazine for the creel bobbins provided at the winding station always contains several creel bobbins, perhaps three to six pieces. This supply is sufficient to make the winding station operative for only a very short time, if one or more of the bobbins in the magazine are unsuited for further processing, and therefore have to be rejected.

The refilling of the magazine for the creel bobbins is performed manually as a rule. However, an automatic refilling can be conceived and is possible.

Since it is very cumbersome to provide a device at each winding station which is capable of finding the thread end on the surface of the bobbin, of holding it and of drawing it out, the thread ends are picked out by hand, as a rule, when the bobbins are placed into the magazine, and are inserted into a holding device, such as a suction device. The thread ends can also be clamped to the suction end of the suction device. In this case, if a bobbin magazine contains a supply of up to six creel bobbins, and their thread ends are sucked in or clamped together, the thread ends can be easily mixed up, so that the winding station of the automatic winding machine is no longer in a position to remove any creel bobbins from the magazine.

It is accordingly an object of the invention to provide an automatic winding machine which overcomes the hereinafore-mentioned disadvantages of the heretofore-known devices of this general type, and to ensure that the thread end of a creel bobbin which is ready for transfer from the magazine to the unwinding position, is reliably found, securely held, and drawn out in such a way that it does not become mixed up with the other thread ends. Furthermore, the acceptance of the thread end is to be further automated, so that operating time is conserved.

With the foregoing and other objects in view there is provided, in accordance with the invention, an automatic winding machine, comprising a plurality of winding stations each having a bobbin unwinding location, a plurality of bobbin magazines each disposed at a respective winding station for receiving a plurality of creel or feeding bobbins on bobbin tubes in alignment or order with respect to their tips or noses, the tubes or bobbins each having a thread end or beginning prepared for unwinding at a given easily accessible location thereon, and a thread suction device disposed above each respective bobbin magazine having a suction opening formed therein facing toward the upper end of a bobbin tube of a bobbin disposed in the bobbin magazine to be transferred to or to assume the unwinding location.

By using this structure, only the thread end of the creel bobbin which is prepared for transfer to the unwinding position is sucked up and secured. It is very unlikely that the thread end of any other bobbin further removed in the magazine would be picked up in this way. This makes it unnecessary to manually pick up the thread ends and insert them at a collecting point.

The suction openings of the thread suction device can therefore always be open. However, due to the great number of winding stations provided in an automatic winding machine, this would cause an excessive amount of suction air to be used. In order to avoid this, it is practical to make the thread suction device, or its suction opening, in such a way that it can be switched on or off. The thread suction device is only required to be activated for short periods of times, i.e. until the thread end is reliably found and sucked up. Thereafter, the thread suction device can be turned off, or its suction opening can be closed. In this case, the sucked in thread end can also be clamped.

In accordance with another feature of the invention, the bobbin magazine is a round magazine having a revolving bobbin advancement mechanism, and including a switching or shifting mechanism connected to the thread suction device operating in conjunction with the revolving advancement mechanism. This has the advantage of ensuring that the motion sequence of the round magazine is in synchronism with the shifting of the thread suction device, and vice versa.

The thread suction device itself can be constructed in a different manner. In this case, two main types are preferred for the further development of the invention. For example, the thread suction device can include a suction tube connected to a suction source leading from winding station to winding station. In principle, such a mechanizm is rather simple. In order to reduce the requirement for suction air the suction tube may be provided with suction openings in the bottom thereof, which can be closed by controllable sliders. For example, in this case a slider of this type is provided at each winding station, and is only opened during the time that a bobbin change takes place. Therefore, in accordance with a further feature of the invention, the thread suction device includes a suction tube extended from winding station to winding station, the suction tube being connectible to a suction source and having the suction openings formed in the bottom thereof, and including a controllable slider for closing the suction openings.

In accordance with an added feature of the invention, the suction tube is a rectangular tube having a substantially C-shaped cross section and having a longitudinal slot formed therein, and including a removable profiled strip covering the longitudinal slot.

In accordance with an additional feature of the invention, the profiled strip is formed of rubbery elastic material and seals the longitudinal slot.

The above-mentioned rectangular tubes are easy to manufacture, and can be obtained as standard parts. The removable profiled strip makes it possible to inspect the interior of the rectangular tube at any time, and to eliminate possible problems due to plugged tubes. For example, the above-mentioned profile strips may have an interior cover strip and an outer cover strip which are connected by a part which can pass through the longitudinal slot of the rectangular tube. If the suction openings are located opposite the longitudinal slot of the rectangular tube, the finishing, smoothing and deburring of the suction openings is also made easier as is their later inspection from the inside.

The other version of the thread suction device in principle has a special suction tube for each winding station. For this purpose, in accordance with again another feature of the invention, the thread suction device includes a suction pipe centrally extended upward through the round magazine, and an air intake elbow or pipe connected to an end of the central suction pipe and bent through an angle of substantially 180°.

Among other things, this construction has the advantage of requiring no additional structural parts which lead from winding station to winding station.

In accordance with again a further feature of the invention, there is provided a slider plate on which the bent air intake elbow or pipe is disposed, the slider plate being controllable for opening and closing the central suction pipe. For example, such a slider plate can be pivoted on a pivot point which lies outside the suction tube.

Since the slider plate is positioned above the bobbin which is ready to be transferred into the unwinding position, it is of advantage if the slider plate is provided at one end thereof with a metallic guide plate which extends over the upper end of the tube of a creel bobbin. This guide plate serves the purpose of guiding the upper end of the bobbin tube to the suction opening of the bent suction pipe. The motion of the slider plate in the direction toward the bobbin, can simultaneously open the suction opening The abovementioned guide plate additionally is used for air supply.

In accordance with again an added feature of the invention, there is provided a thread breakage correction device movable from winding station to winding station as needed, the thread suction device including a shifting or switching mechanism operatively connected to the thread breakage correction device. Such a thread breakage correction device will initiate the replacement of a creel bobbin as it becomes empty. Therefore, it is practical if the thread breakage correction device also performs the function of shifting the thread suction device and possibly of shifting the magazine as well.

Therefore, in accordance with again an additional feature of the invention, the bobbin magazine includes another switching or shifting mechanism operatively connected to the thread breakage correction device, and the thread breakage correction device includes a control unit for controlling the shifting or switching mechanism in common. This is especially advantageous if the thread breakage correction device can travel and can service five to ten winding stations, for example, as required. In this case it is not necessary to provide a control unit for each winding station.

The use of a round magazine leads to further advantageous developments of the invention.

In accordance with yet another feature of the invention, the round magazine has a bottom having an opening formed therein for the discharge of creel bobbins in direction toward the unwinding location, the opening defining an edge of the bottom having onstructions formed thereon for holding back a bobbin to be transferred from the magazine at the foot of the bobbin. This holding back function is of advantage, because due to the revolving advancing device of the round magazine, the bobbin itself is taken along in the transport direction, so that the tip of the tube is also moved in a reliable manner in the transport direction, if the foot of the tube is held back. This is contemplated and is advantageous because in this way the tip of the tube is better positioned near the thread suction device.

In accordance with a concomitant feature of the invention, the round magazine has a given location below the thread suction device from which a bobbin is to be transferred toward the bobbin unwinding location, and a support device disposed below the bobbin to be transferred in the given location being swingable out of the way.

Support devices of this type were not required heretofore, and are not provided in conventional round magazines. However, in this case the support device serves the purpose of exposing the creel bobbin to the suction flow of the thread suction device for a somewhat longer period of time and in a better manner.

In case the beginning of the thread is prepared for being gripped by inserting it into the interior of the bobbin tube, it is proposed that the support device be formed of a plate which is provided with uneven surface portions and/or openings which permit access of air into the foot of the bobbin tube. The air current from the thread suction device in this case enters the interior of the bobbin tube, and pulls the thread along. The above-mentioned uneven portions may be wires of screen, grooves, corrugations or holes, just to mention a few examples.

Other features which are considered as characteristic for the invention are set forth in the appended claims.

Although the invention is illustrated and described herein as embodied in an automatic winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
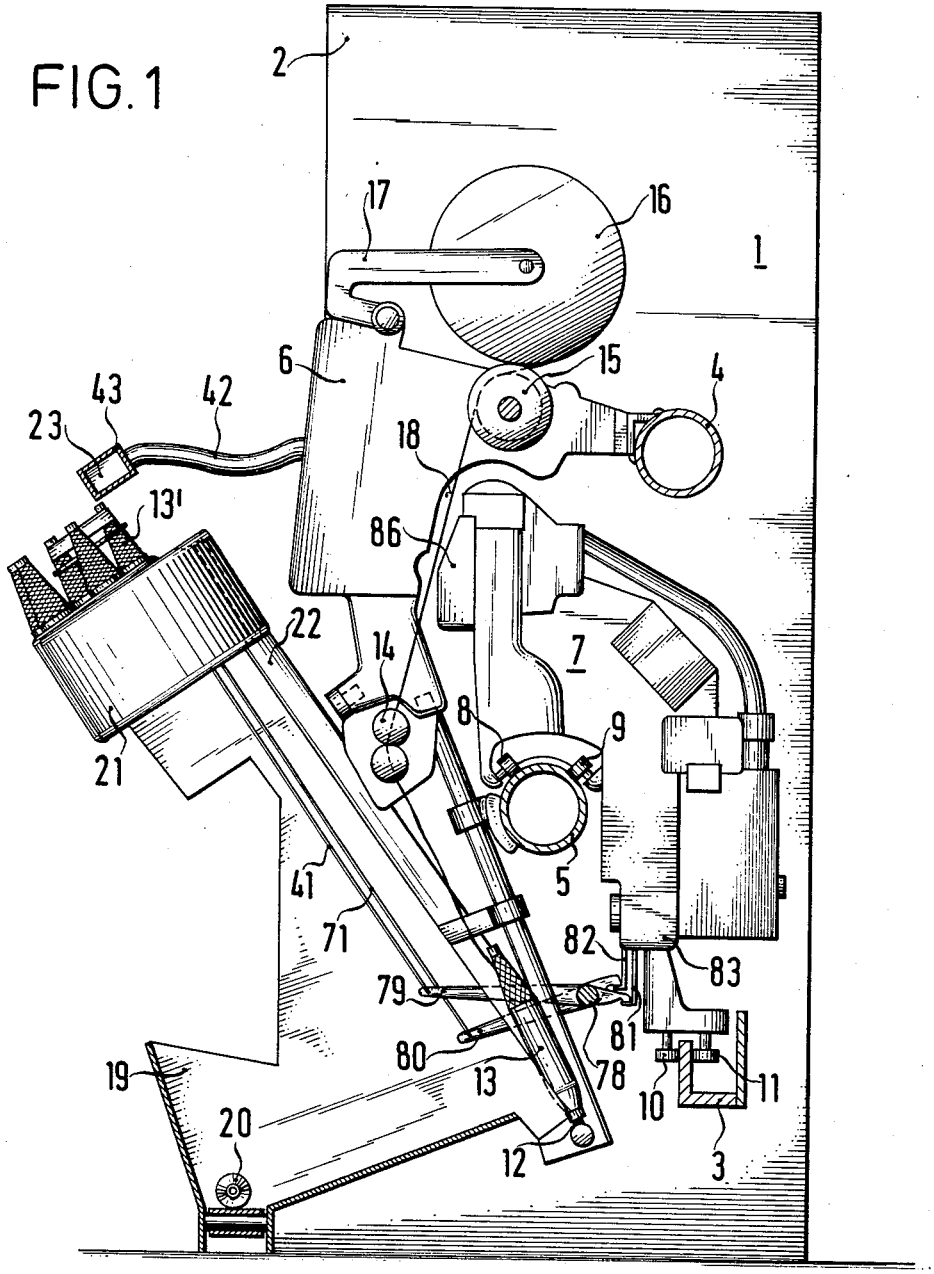
FIG. 1 is a diagrammatic partially cross-sectional side-elevational view of a winding station of an automatic winding machine.

Referring now to the figures of the drawing in detail and first particularly to FIG. 1 thereof, there is seen an automatic winding machine 1 which includes a rear frame 2 and a front frame which is not shown in the figure. The two frames are located at the ends of the machine and are connected with each other by a profiled traverse 3 and two tubular traverses 4 and 5. A winding station 6, which is shown in detail in FIG. 1, is fastened to the tubular traverses 4 and 5. A thread breakage correction device, which is designated as a whole with reference numeral 7, is supported on rollers 8 and 9 on the tubular traverse 5, and rests with support rollers 10 and 11 on the profiled traverse 3. The tubular traverse 5 serves as a guide rail of the thread breakage correction device 7, and the profiled traverse 3 serves as a support rail therefor.

The winding station 6 includes the following main parts: an unwinding station 12 with feeding or creel bobbins 13, a thread tensioning device 14, and a drive roller 15 provided with cross winding grooves for a winding bobbin 16 in the form of a cross wound bobbin or cheese having a pivotable holder designated with reference numeral 17. The crossed thread grooves of the drive roller simultaneously serve for guiding a thread 18. A collection trough 19 for ejected empty feeding or creel bobbins 20 is provided at floor level.

A creel bobbin or unwinding bobbin magazine 21 which is also a part of the winding station 6, is constructed in the form of a round magazine and is attached to a slide 22 which leads to the unwinding station 12.

Figure 2:
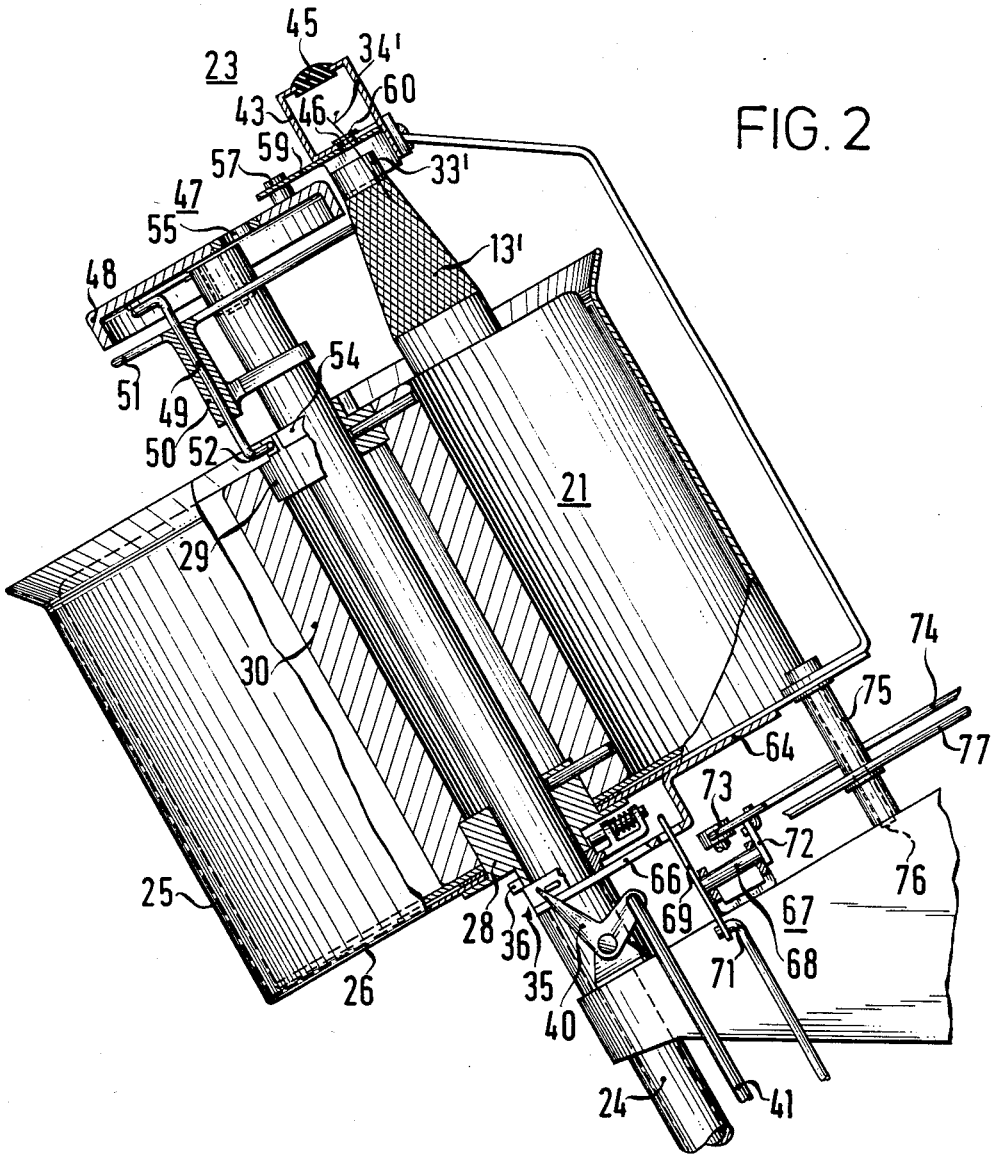
FIG. 2 is a fragmentary partially broken-away cross-sectional view of the creel bobbin or feeding bobbin magazine of the winding station shown in FIG. 1.
Figure 3:
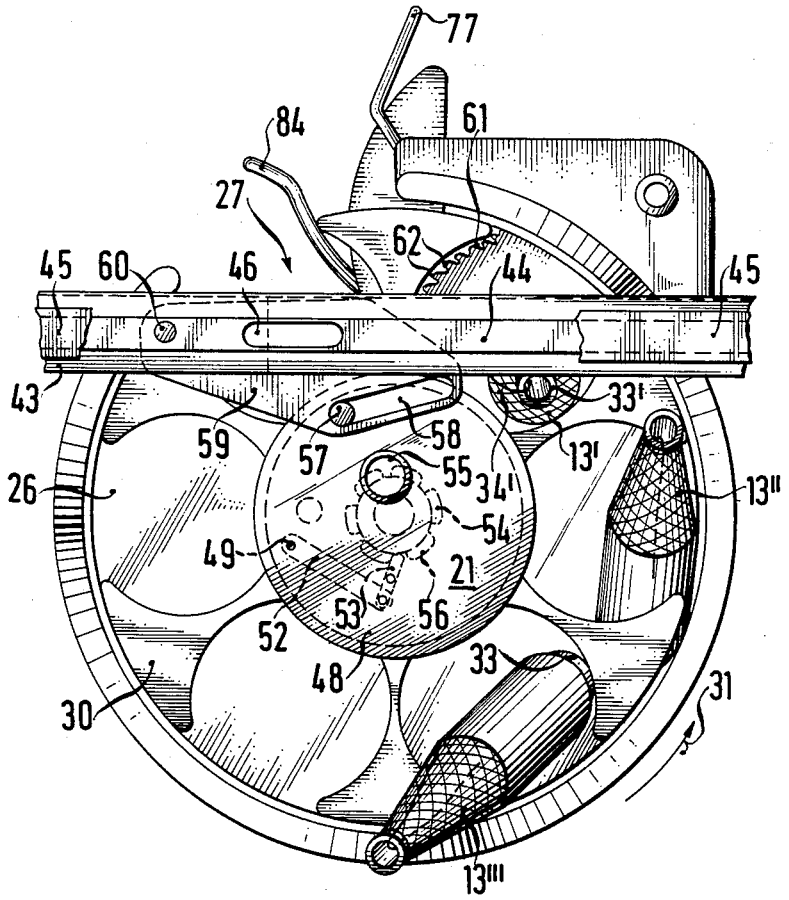
FIGS. 3, 4 and 5 are fragmentary top plan views of the feeding bobbin magazine.

A thread suction device 23 is disposed above the creel bobbin magazine 21. Additional feeding or creel bobbins 13' are positioned in the creel bobbin magazine 21. According to FIGS. 2 to 5, the creel bobbin magazine 21 has a stationary central tube in form of a suction tube 24, a central container 25 which is open at the top and has a bottom 26 with an opening 27 formed therein as seen in FIG. 3 for permitting the discharge of a creel bobbin 13' as shown in FIG. 2, in direction toward the unwinding station 12 seen in FIG. 1. The opening 27 in the bottom 26 has substantially the shape of a sector of a circle. The central tube 24 carries two bearing sleeves 28 and 29 which support a holding star or spider 30 that can rotate in the transport direction. This transport direction is indicated by an arrow 31 in FIG. 3. The holding spider 30 forms six pockets 32, which serve to hold the creel bobbins 13', 13''and 13'''.

FIG. 3 illustrates that the creel bobbins are spinning bobbins or cops wound on creel bobbin tubes 33'. The lower end of the tubes 33' rests on the bottom 26 of the magazine 21, while at the upper end of the creel bobbin tube, it can be seen that the beginning 34' of the thread is inserted into the interior of the tube, so that the beginning of the thread is ready to be gripped at a given location. For example, creel bobbins with a thread beginning which is prepared in such a way that it is ready to be gripped, can be manually inserted into the pockets of the round bobbin magazine 21.

Figure 6:
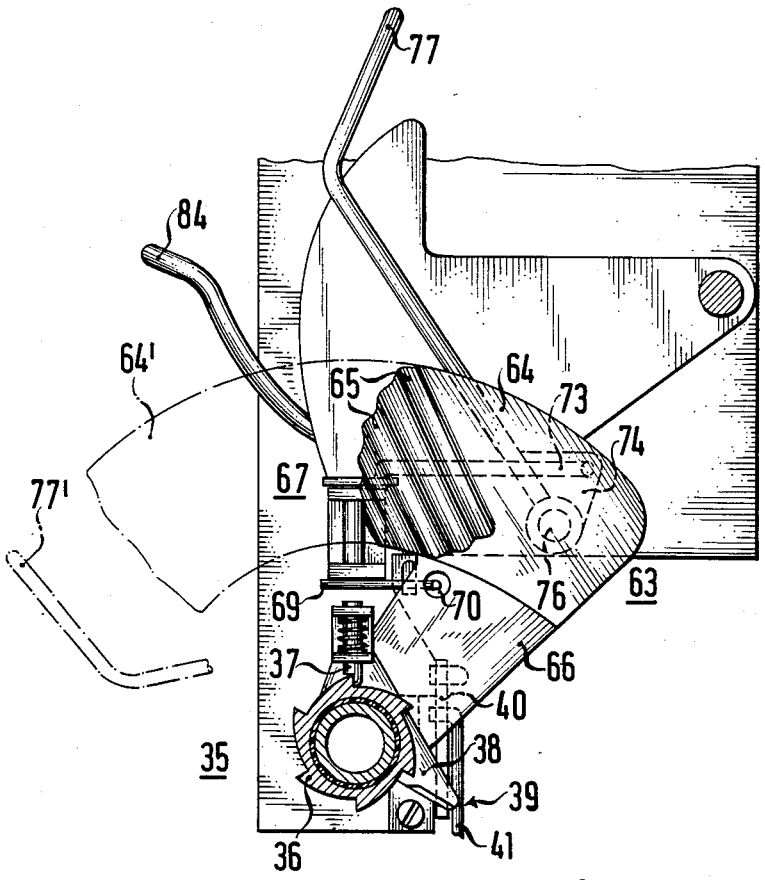
FIG. 6 is a fragmentary elevational view of a pivotable support mechanism of the creel bobbin magazine.

The round magazine 21 is provided with a revolving bobbin advancement or cop building mechanism 35 shown in FIG. 6, which makes it possible to rotate the holding spider 30 one step at a time, in direction of the arrow 31. For this purpose, the bearing sleeve 28 is provided with a ratchet wheel 36 and a latch 37 is provided for preventing rotation in the opposite direction. A locking pawl 38 which engages the locking wheel 36 is part of an indexing or switching mechanism which is designated as a whole with reference numeral 39. An angular lever 40 and an indexing or switching rod 41, also belong to the mechanism 39.

The suction device 23 for the thread is provided with a suction tube 43 connected by a hose line 42 to a suction or low pressure source. The tube 43 leads from winding station to winding station. The suction tube 43 is constructed in the form of a rectangular tube with a C-shaped cross section. A longitudinal slot 44 formed in the suction tube 43 is covered and sealed by a removable profiled strip 45. The profiled strip 45 is formed of a rubber elastic material. The strip 45 can be easily inserted by hand, and can also be removed again.

The suction tube 43 is provided with suction openings at the bottom thereof. For example, FIG. 3 shows a suction opening 46. The suction opening 46 is oriented toward the upper end or tip of the bobbin tube 33' of a creel bobbin 13' which is kept ready in the bobbin magazine 21 for being transferred to the unwinding position shown in FIG. 2.

The thread suction device 23 is provided with a switching mechanism at each winding station 6. The switching mechanism is designated with reference numeral 47 at the winding station 6 in FIG. 2 The switching mechanism 47 includes a cover 48, disposed in a central position on the upper end of the suction tube 24, closing the suction tube. The cover 48 is supported on a shaft 49 so that it can move eccentrically. A support bearing 50 in a plate 51 which is fastened to the suction tube 24, provides this motion. The shaft 49 carries a control or switching wing or blade 52 at its lower end which engages in a star wheel 54 with a key projection 53. The star wheel 54 is connected to the bearing sleeve 29.

The cover 48 is provided with an eccentrically positioned opening 55, which is always in front of the opening of the suction tube 24 when the projection 53 is positioned on a high portion of the star wheel 54, after the pivoting motion of the cover 48.

The cover 48 is also provided with an eccentrically disposed pin 57, seen in FIG. 3, which engages in a coulisse or link 58 of a slider 59. The slider 59 is fastened to a pivot joint 60 which is connected to the suction tube 43. The bottom of the slider rests on the suction tube 43, and thereby closes the suction opening 46, as shown in FIG. 3. However, when the switching device 47 is in the suction position, shown in FIG. 4, the slider 59 keeps a part of the suction opening clear.

Figure 4:
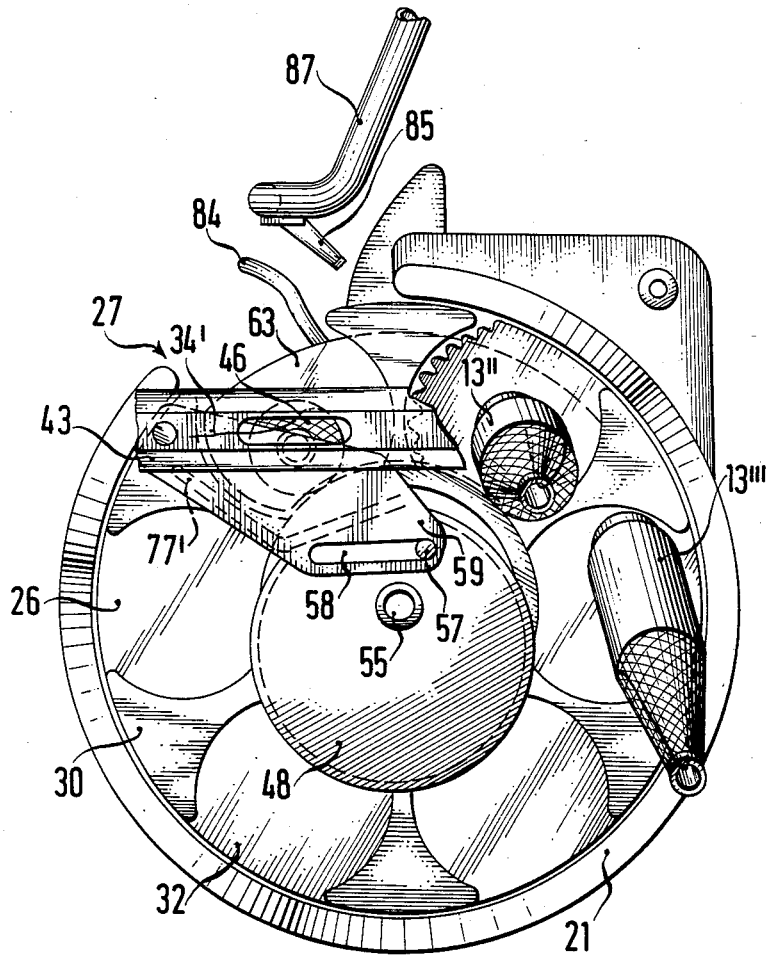
Figure 5:
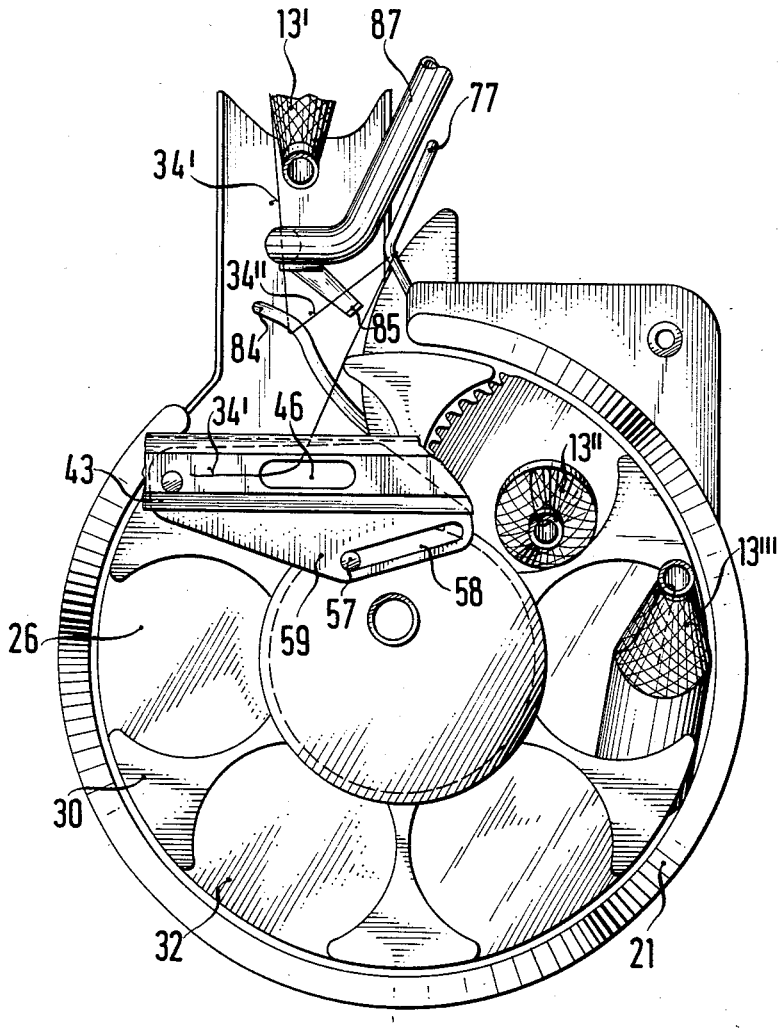

FIGS. 3 to 5 show that the edge 61 of the opening 27 of the bottom 26 which is directed against the direction of motion of the round magazine 21, is provided with obstructions 62. These obstructions 62 are in the form of obliquely upwardly bent teeth, which are constructed in such a way that the bobbin 13' which is to be readied for its discharge from the round magazine 21, is held back at the foot of the tube, as the holding spider 30 moves in the direction of the arrow 31 in FIG. 3.

FIGS. 4 and 6 show especially clearly that a support mechanism 63 which can swing away is provided below the creel bobbin 13, at the location where one creel bobbin 13' is to be transferred in the direction toward the unwinding station 12. The support mechanism 63 is formed of a plate 64 with uneven surface portions 65 which permit access of air to the foot of the tube. These uneven surface portions 65 are in the form of corrugations which are pressed into the plate 64. According to FIG. 2 and FIG. 6, the plate 64 is provided with a holding arm 66, which can pivot on the central tube 24. An operating mechanism, designated with reference numeral 67, is connected to the holding arm 66, as shown in FIG. 2. The operating mechanism 67 has a pivot shaft 68, to which a two-armed lever 69 is fastened. One of the ends of the lever 69 extends through an opening 70 provided in the holding arm 66. The other end of the lever 69 is connected to a switching rod 71.

The pivot shaft 68 which carries the lever 69 at one end thereof, has a lever 72 at its other end which articulates with a rod 73. The rod 73 articulates with a plate 74 which is fastened to a sleeve 75. The sleeve 75 is pivotably supported on a stationary bolt 76, and carries a thread or yarn catching hook 77. The thread catching hook 77 serves for transfering the beginning of the thread of a new creel bobbin to the thread breakage correction device 7.

Before describing another embodiment of the invention, the operation of the above-described device will be explained.

FIG. 1 shows the winding station 6 in normal operation. The thread 18 is pulled from the creel bobbin 13 and wound onto the winding bobbin 16.

Assuming the creel bobbin has become empty, the winding station 6 automatically notices that the thread 18 is missing, and sends a signal that the "thread is missing" to the thread breakage correction device 7.

Due to this signal, the thread breakage correction device 7, which moves back and forth on the tubular traverse 5, stops in front of the winding station 6, and initiates all operations which are necessary in order to eliminate the interruption of the thread. At this point it is necessary to first sense if a creel bobbin is positioned at the unwinding station 12 with a sufficiently large supply of thread. Since this is not the case, the empty bobbin is first removed by the thread breakage correction device 7, and ejected into the collection trough 19. The details of this operation will not be further explained at this point.

A horizontal shaft 78 is provided at the winding station 6 on which two-armed levers 79 and 80 are pivotably supported. The short ends of the two-armed levers 79, 80 are directed toward pulling hooks 81, 82, respectively, which belong to a control unit 83 of the thread breakage correction device 7. The lever 79 articulates with the switching rod 41, and the lever 80 articulates with the switching rod 71.

The round magazine is in the position indicated in FIG. 3. There are three creel bobbins 13', 13'' and 13''' inserted in the magazine. The suction opening 46 is closed by the slider 59. The creel bobbin 13' must first be moved under the suction opening 46 for sucking up the thread end 34'. For this purpose, it is necessary to bring the plate 64 of the support device 63 into the position 64' which is shown in FIG. 6. This is done by the operating mechanism 67, at which point the control unit 83 of the thread breakage correction device 7 lifts the pulling hook 82, causing the lever 80 to swing, and thereby pulling the rod 71 downward. Simultaneously with the movement of the plate 64, the thread catching hook 77 also swings back, and assumes the position 77'.

Thereafter, the control unit 83 lifts the pulling hook 81, so that the lever 79 is moved, and pulls the switching rod 41 downward. This directly operates the revolving cop building or bobbin advancement mechanism 35 and indirectly operates the switching mechanism 47. As the revolving cop advancement mechanism is operated according to FIG. 6, the locking pawl 38 moves the ratchet wheel 36 ahead one tooth, so that the holding spider 30 is rotated forward in the direction of the arrow 31 by one step, as seen in FIG. 4. As long as the switching rod 41 remains in the pulled position, the projection 53 shown in FIG. 3 remains on a raised portion 56 of the star wheel 54, so that the opening 55 of the cover 48 keeps the discharge opening of the suction tube 24 open, and the slider 59 holds the suction opening 46 open.

The suction air in the thread suction device 23 therefore passes through the suction opening 46 and acts on the bobbin 13' which is now positioned according to FIG. 4 under the suction opening. The suction air especially acts on the bobbin tube, so that the beginning of the thread 34' enters into the suction tube 43 of the thread suction device 23.

During the time that the creel bobbin 13' moves one step from the position shown in FIG. 3 to the position shown in FIG. 4, the foot of the tube is held back and braked by the obstructions 62, so that the bobbin is moved under the suction opening 46, leading with the point of the tube. The corrugations of the plate 64 serve the purpose of permitting the air to flow into the tube from the bottom.

When the beginning of the thread is sucked up, the control unit 83 lowers the pulling hook 81 again, thereby lifting the rod 41 again. This measure causes the revolving cop advancing mechanism 35 and the switching mechanism 47 to again move to their starting positions. According to FIG. 5, the slider 59 closes the suction opening 46, and thereby clamps the beginning 34' of the thread. The control unit 83 then also lowers the pulling hook 82, so that the rod 71 is also lifted again. This also returns the operating mechanism 67 and the support device 63 back to their starting positions. The creel bobbin thus loses its bottom support, and slides through the slide 22 into the unwinding station 12. However, the beginning of the thread remains clamped between the suction opeaning 46 and the slider 59.

While the plate 64 moves back to the starting position, the thread catching hook 77 also moves from the position 77' to its rest position. The hook 77 therefore takes along the beginning of the thread 34', as shown in FIG. 5. With the aid of a fixed guide hook 84, the thread forms a thread loop 34'', which can be grabbed by a thread gripper 85, and can be conducted to a thread joining head 86 of the thread breakage correction device 7. The thread gripper 85 is part of additional devices which will not be further explained herein. During the thread joining operation, the sucked up and clamped end of the thread beginning 34' is severed, and then sucked away into the suction tube 43 when the suction opening 46 opens the next time.

Besides the automatic loading of the magazine in which the thread end is sucked in by the suction tube 43, a bobbin may be manually inserted into a pocket 32. In this case, the suction tube 24 sucks in a thread manually inserted through the opening 55 after rotating the cover 48. The cover 48 automatically closes to stop the suction and it is automatically opened so that the thread end can be picked up as described above when a bobbin is released onto the slide 22.

Figure 7:
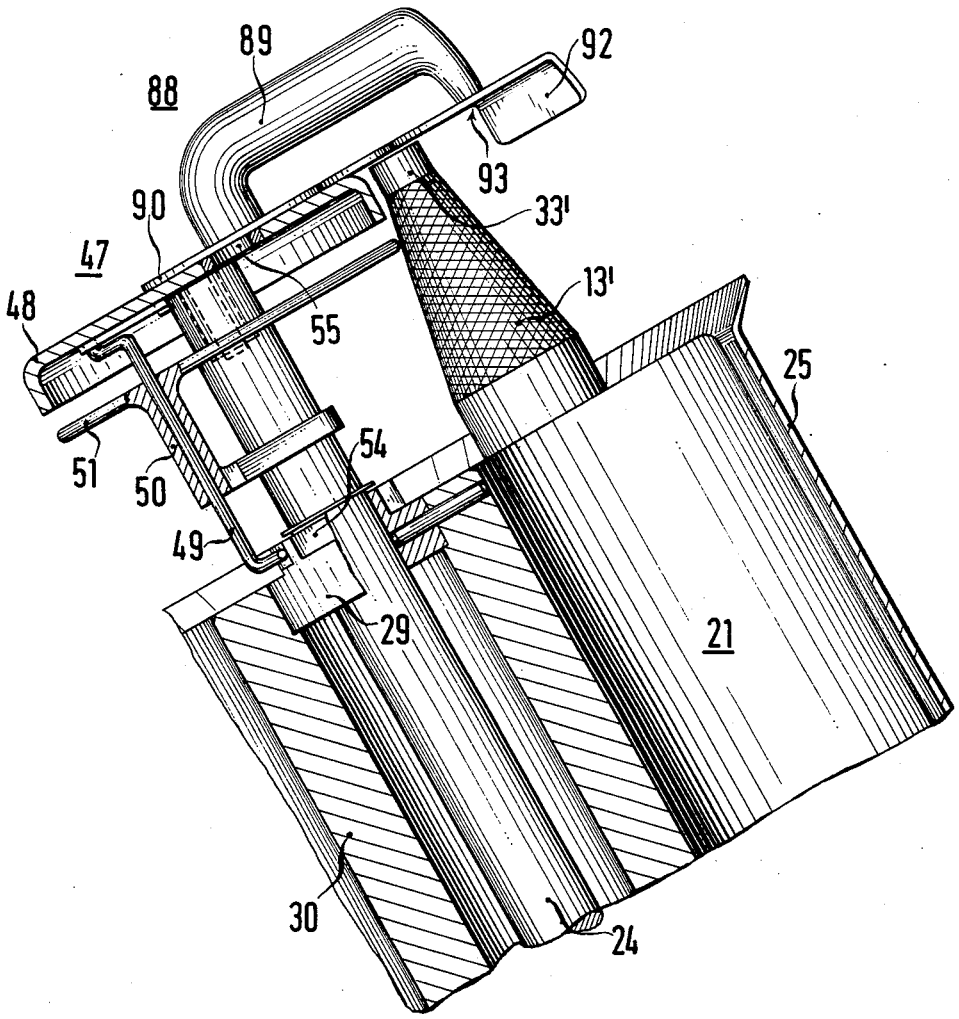
FIG. 7 is a fragmentary partially cross-sectional view of another type of creel bobbin magazine in the form of a bent suction pipe.
Figure 8:
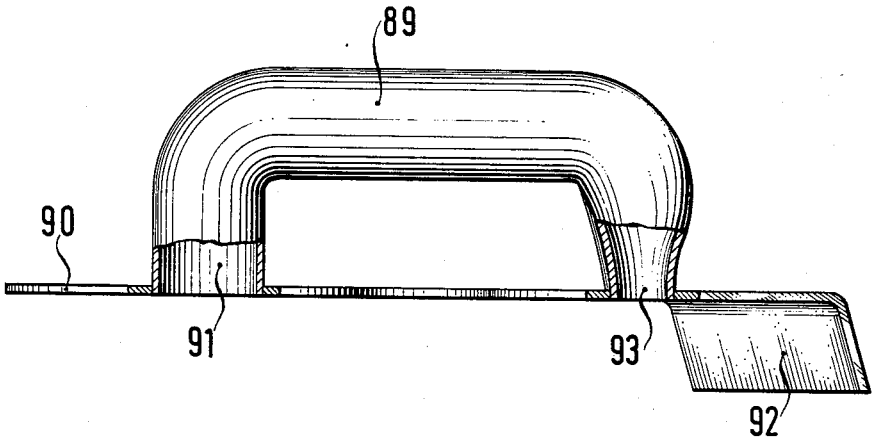
FIGS. 8 and 9 are two elevational views of the bent suction pipe according to FIG. 7.
Figure 9:
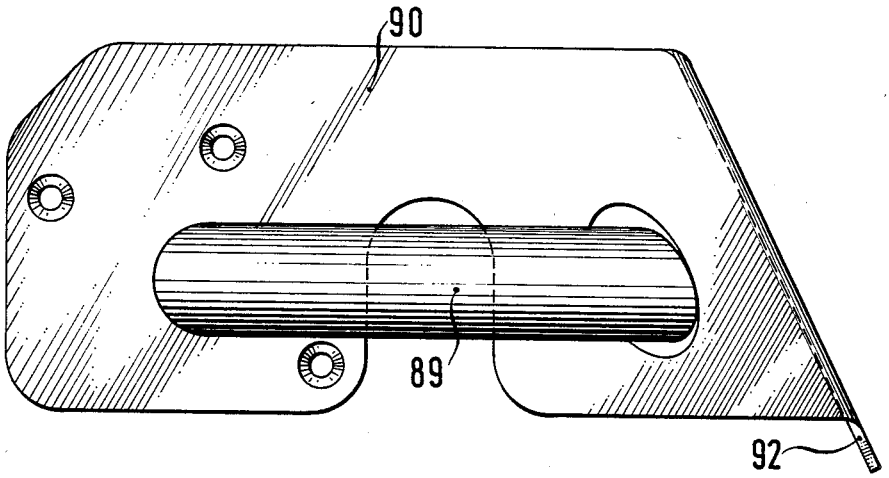
Figure 10:
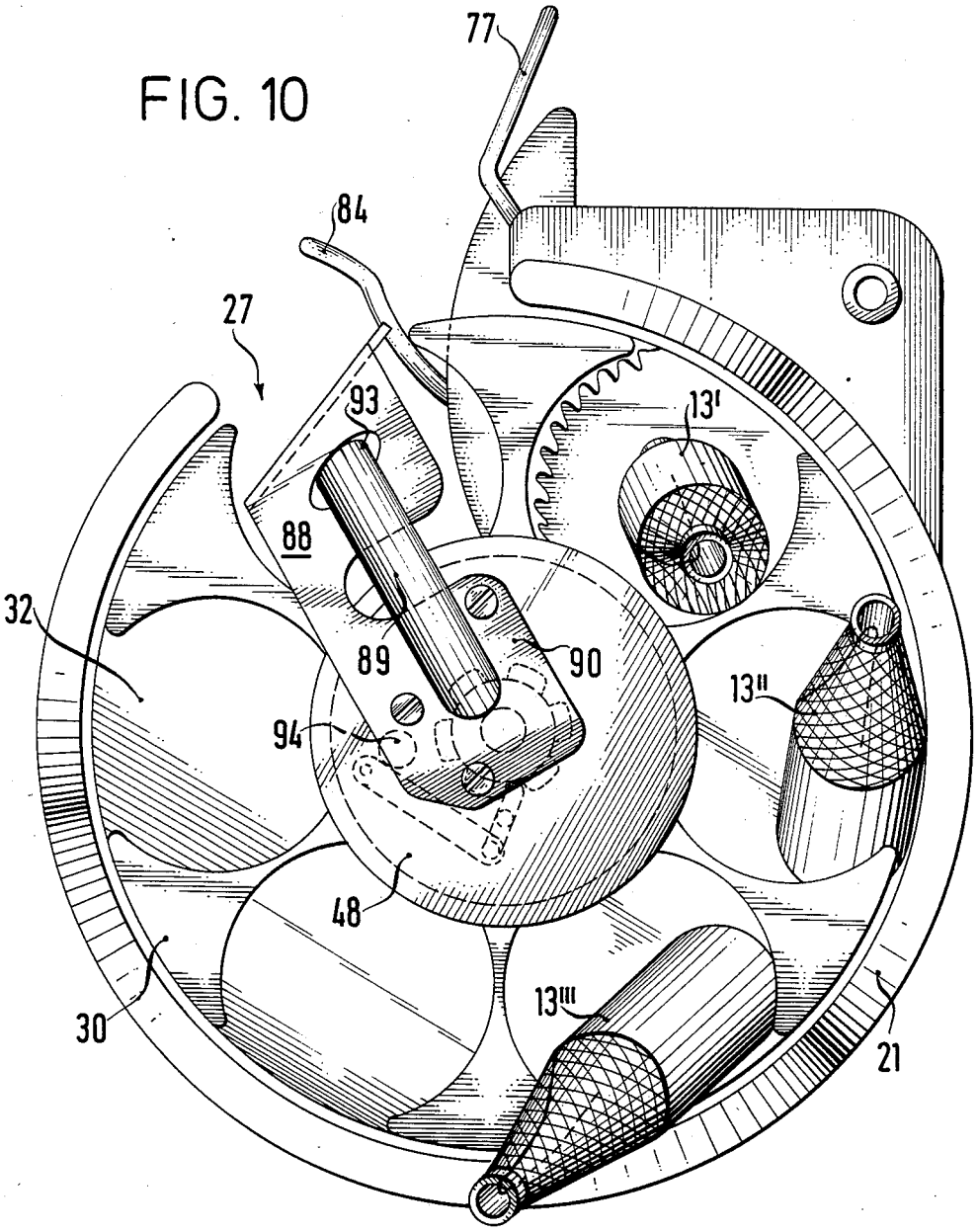
FIGS. 10 and 11 are top plan views of the creel bobbin magazine according to FIG. 7.
Figure 11:
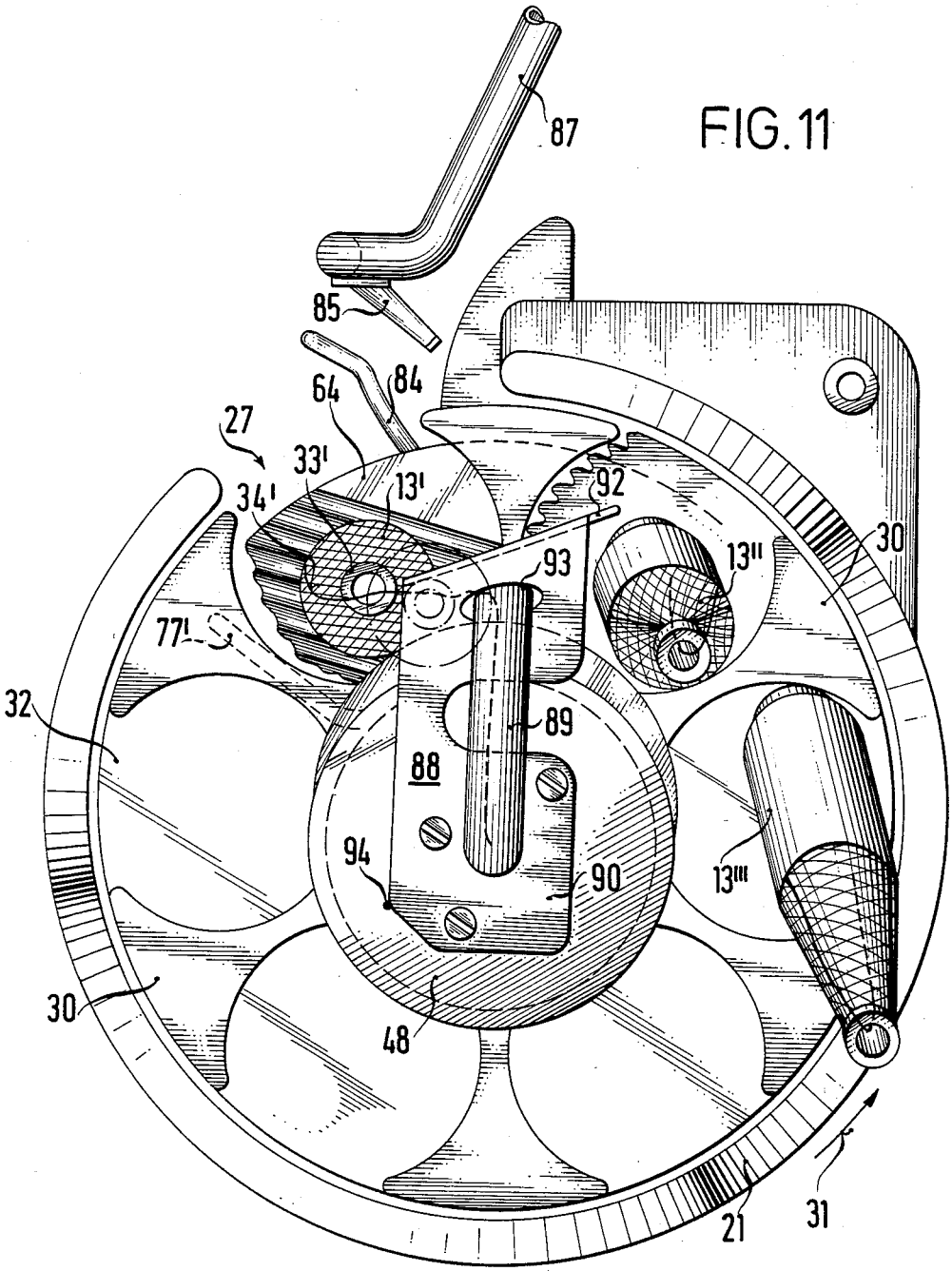

In an alternate embodiment according to FIGS. 7 to 11, a round magazine 21 shown in the first embodiment is also provided. Consequently, details of the magazine will not be further explained again. However, a thread suction device 88 is provided which is constructed differently in this embodiment. This embodiment also has the abovementioned suction tube 24 which is centrally conducted upward through the round magazine 21, so that the suction tube ends in a suction pipe 89 which is bent through 180 degrees. The suction pipe 89 is disposed on a slider plate 90 which either opens or closes the suction tube 24, in a controlled manner. The slider plate 90 is fastened to the previously-mentioned cover 48, in such a way that the discharge opening 91 of the suction pipe 89 lies above the opening 55 of the cover 48. The slider plate 90 is provided at the end thereof with a metallic guide plate 92 which extends above the upper end of the bobbin tube 33' of the creel bobbin 13'. In this case, a suction opening 93 of the thread suction device 88 is also directed toward the upper end of a bobbin tube 33' of a creel bobbin 13' which is kept ready in the feeding magazine 21 for transfer to the unwinding position. As in the first embodiment, the suction tube 24 is also connected to a source of suction air FIG. 10 shows the basic position of the thread suction device 88. The round magazine 21 holds the creel bobbins 13', 13'' and 13''' in readiness. The suction opening 93 is positioned above the opening 27 of the round magazine. The next following creel bobbin 13' is to be transferred to the winding station through this opening For this purpose, the support mechanism described with respect to the first embodiment is operated, and its plate 64 is moved under the opening 27, as shown in FIG. 11. The switching mechanism 47 shown in FIG. 7 is operated, with the result that the cover 48, and therefore the thread suction device 88, swings around a pivot point 94 to the position shown in FIG. 11. This occurs simultaneously with the motion of the holding spider 30 in the direction of arrow 31 advancing one step, so that the feeding bobbin 13' is pushed ahead onto the plate 64, as shown in FIG. 11 As it is transported, the bent suction pipe 89 of the thread suction device 88 swings toward the creel bobbin 13'. The upper end of the bobbin tube 33' therefore slides along the guide plate 92, and is guided under the suction opening 93. While the bent suction tube 89 moves clockwise around the pivot point 94, its discharge opening 91 is positioned above the upper end of the suction tube 24. The air flowing into the bent suction tube 89 forcefully takes the beginning of the thread 34' along with it. Simultaneously with the motion of the plate 64, the thread catching hook 77 moves to the position 77'.

FIG. 11 shows that a thread gripper 85 is already held in readiness by the device 87, in order to receive the sucked up thread beginning 34'. This happens when the creel bobbin 13' is transferred to the unwinding station 12 of the winding station 6 by the backward swinging of the plate 64. While the plate 64 moves back, the bent suction tube 89 moves to its basic or starting position. The sucked up thread is therefore clamped between the cover 48 and the discharge opening of the suction tube 24. As the creel bobbin 13' slides downward on the slide 22, the thread unwinds from the bobbin, is picked up by the thread catching hook 77, is pulled out to form a loop, and is conducted to the thread gripper 85.

The parts of the round magazine 21 which are not specially described are the same as in the first embodiment. In general, the invention is not limited to the illustrated and described embodiments which were used as examples.

We claim:

1. Automatic winding machine, comprising a plurality of winding stations each having a bobbin unwinding location, a plurality of bobbin magazines each disposed at a respective winding station for receiving a plurality of bobbins on bobbin tubes in order with respect to their tips, the bobbins each having a thread end prepared for unwinding at a given location thereon, a thread suction device disposed above each respective bobbin magazine having a suction opening formed therein facing the upper end of a bobbin tube of a bobbin disposed in said bobbin magazine to be transferred to said unwinding location, said thread suction devices at each winding station including a suction tube extended from winding station to winding station, said suction tube being connectible to a suction source and having said suction openings formed in the bottom thereof, and a controllable slider at each winding station for individually closing a respective one of said suction openings.

2. Automatic winding machine according to claim 1, wherein said suction tube is a rectangular tube having a substantially C-shaped cross section and having a longitudinal slot formed therein at each winding station, and including a removable profiled strip at each winding station covering said longitudinal

3. Automatic winding machine according to claim 2, wherein said profiled strip is formed of rubbery elastic material and seals said longitudinal slot.

4. Automatic winding machine according to claim 1, including a thread breakage correction device movable from winding station to winding station as needed, said thread suction device including a switching mechanism operatively connected to said thread breakage correction device for shifting said thread suction device.

5. Automatic winding machine according to claim 4, wherein said bobbin magazine at each winding station includes another switching mechanism operatively connected to said thread breakage correction device, and said thread breakage correction device includes a control unit for controlling said switching mechanisms in common.

6. Automatic winding machine, comprising a plurality of winding stations each having a bobbin unwinding location, a plurality of bobbin magazines each disposed at a respective winding station for receiving a plurality of bobbins on bobbin tubes in order with respect to their tips, the bobbins each having a thread end prepared for unwinding at a given location thereon, a thread suction device disposed above each respective bobbin magazine having a suction opening formed therein facing the upper end of a bobbin tube of a bobbin disposed in said bobbin magazine to be transferred to said unwinding location, said bobbin magazine at each winding station being a round magazine having a revolving bobbin advancement mechanism, a switching mechanism connected to said thread suction device at each winding station for shifting said thread suction device in dependence on said revolving advancement mechanism, said thread suction device at each winding station including a suction pipe centrally extended upward through said round magazine, an air intake pipe at each winding station connected to an end of said central suction pipe and bent through an angle of substantially 180°, and a slider plate at each winding station on which said bent air intake pipe is disposed, said slider plate being controllable for opening and closing said central suction pipe.

7. Automatic winding machine according to claim 6, wherein said round magazine at each winding station has a bottom having an opening formed therein for the discharge of bobbins in direction toward said unwinding location, said opening defining an edge of said bottom having obstructions formed thereon for holding back a bobbin to be transferred from said magazine at the foot of the bobbin.

8. Automatic winding machine according to claim 6, wherein at each winding station said round magazine has a given location below said thread suction device from which a bobbin is to be transferred toward said bobbin unwinding location, and a support device disposed below said given location being swingable out of the way.

* * * * *